US005974697A

United States Patent [19]

Tseng

[11] Patent Number: 5,974,697

[45] Date of Patent: Nov. 2, 1999

[54] SAFETY SHOE

[75] Inventor: Chung-Shinn Tseng, Taipei, Taiwan

[73] Assignee: New Tradewell Corporation, Taipei, Taiwan

[21] Appl. No.: 09/140,292

[22] Filed: Aug. 25, 1998

[51] Int. Cl.[6] ..... A43C 13/14; A43B 23/00

[52] U.S. Cl. ..... 36/77 R; 36/107

[58] Field of Search ..... 36/107, 106, 72 R, 36/77 R, 76 R

[56] References Cited

U.S. PATENT DOCUMENTS 3,034,235 5/1962 Hunting et al. ..... 36/77 R 3,986,279 10/1976 Gagnon ..... 36/77 R 5,007,184 4/1991 Lee ..... 36/77 R

*Primary Examiner*—B. Dayoan

*Attorney, Agent, or Firm*—Jackson Walker, L.L.P.

[57] ABSTRACT

A heavy duty shoe has a steel plate mounted therein for protecting transverse arch of a user from being hurt by exterior sharpened objects and an arcuate steel cap mounted in a front portion of the shoe for protecting toes of the user from being hurt. A recess is defined in the front portion of the shoe, such that when the steel cap is mounted within the shoe, the ends of which are able to be flush with a shoe pad disposed within the shoe to provide a pleasant wearing environment to the user.

4 Claims, 4 Drawing Sheets

SAFETY SHOE

FIELD OF THE INVENTION

The present invention generally relates to a heavy duty shoe, and more particularly to a heavy duty shoe which has a steel plate mounted therein for protecting transverse arch and sole of a user from being hurt by exterior sharpened objects and an arcuate steel cap mounted in a front portion of the shoe for protecting toes of the user from being hurt.

BACKGROUND OF THE INVENTION

It is common for workers to wear heavy duty boots in a work site. A conventional heavy duty boot has a structure as shown in FIG. 5, wherein the heavy duty boot is constructed to have a vamp 60 provided with a first fold 601, a steel cap 61 with a second fold 611 enclosed within the vamp 60 and mounted in a front portion of the boot, a lining 62 provided with a third fold 621 securely attached to the steel cap 61, a board 63 securely mounted within the shoe and between the steel cap 61 and the lining 62 and a sole 64 securely connected with the vamp 60. With the structure mentioned above, it is to be noted that due to the first fold 601 of the vamp 60, the second fold 611 of the steel cap 61, the board 63 and the third fold 621 of the lining 62 being superposed on top of each other, the shape of the heavy duty boot will not be very pleasant and the weight of the boot will also be very heavy.

Furthermore, when having a customer or client coming to the work site, the customer or client will have to change the "elegant shoes" to the heavy duty shoes for the consideration of safety, which will increase inconvenience to the user and will increase economic burden to the user as well in that the user will have to spend extra money to buy another pair of shoes for this kind of occasion.

However, to improve the inconvenience caused by conventional heavy duty boots, the present invention introduces a heavy duty shoe to mitigate and/or obviate the aforementioned problems.

SUMMARY OF THE INVENTION

The main object of the present invention is to provide a heavy duty shoe having a steel sheet mounted therein for protecting the transverse arch and sole of a user from being hurt by exterior sharpened objects and an arcuate steel cap mounted in a front portion of the shoe for protecting toes of the user from being hurt.

Another object of the present invention is to define a recess in a front portion within the shoe, such that a pad is placed in the recess to provide comfort to the user.

Other objects, advantages and novel features of the invention will become more apparent from the following detailed description when taken in conjunction with the accompanying drawings.

DETAILED DESCRIPTION OF PREFERRED EMBODIMENT

Figure 1:
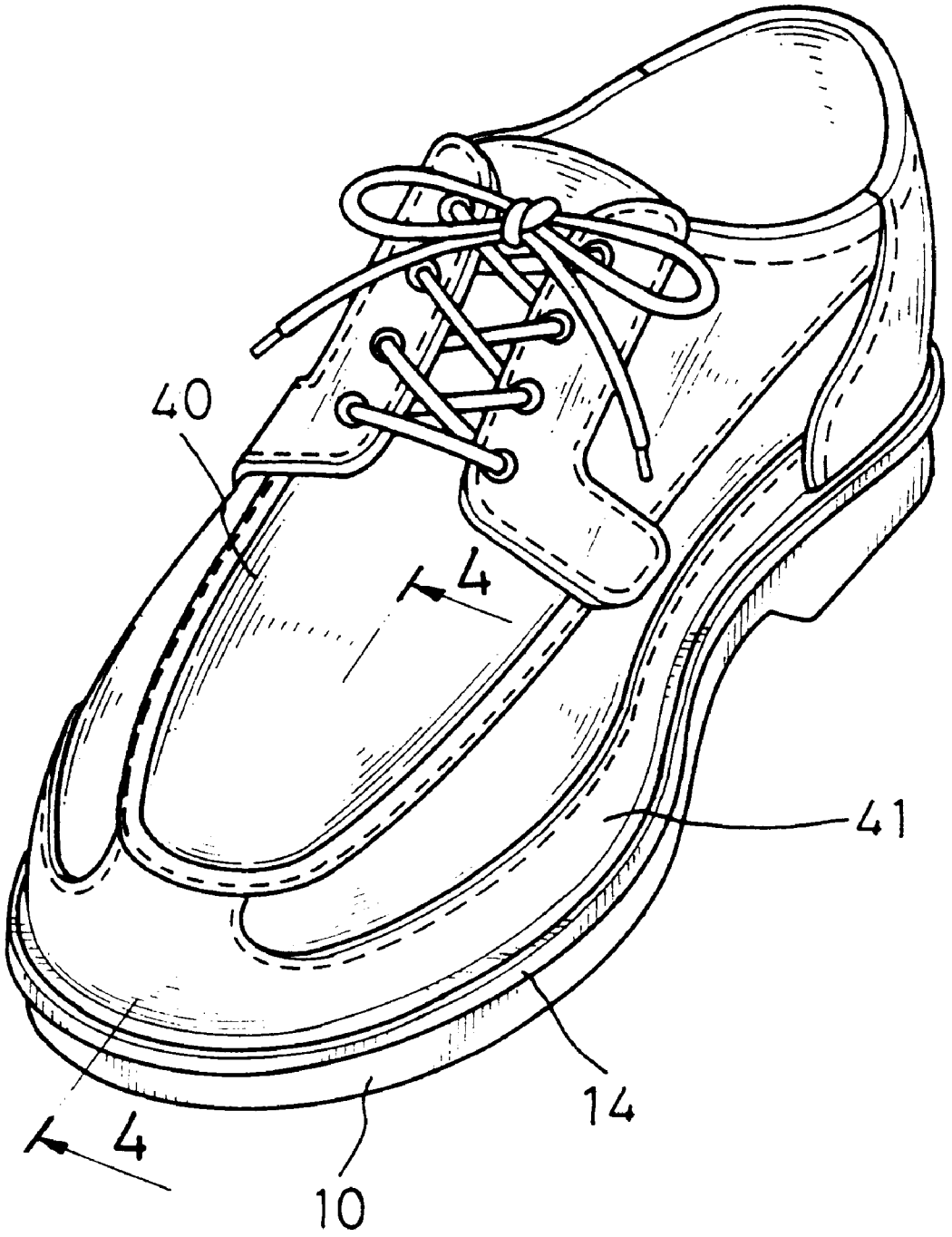
FIG. 1 is a perspective view of a heavy duty shoe constructed in accordance with the present invention.

Referring to FIG. 1, a heavy duty shoe constructed in accordance with the present invention is shown. It is to be noted that the shoe is made to have a shape of an ordinary, every-day style. The shoe is no longer heavy and ugly. The shoe has a vamp 40, a quarter 41 securely attached to the vamp 40 by a method called "OPANKA CONSTRUCTION", a welt 14 attached to a peripheral edge of the quarter 41 and a sole 10 securely attached to the welt 14 and the quarter 41.

Figure 2:
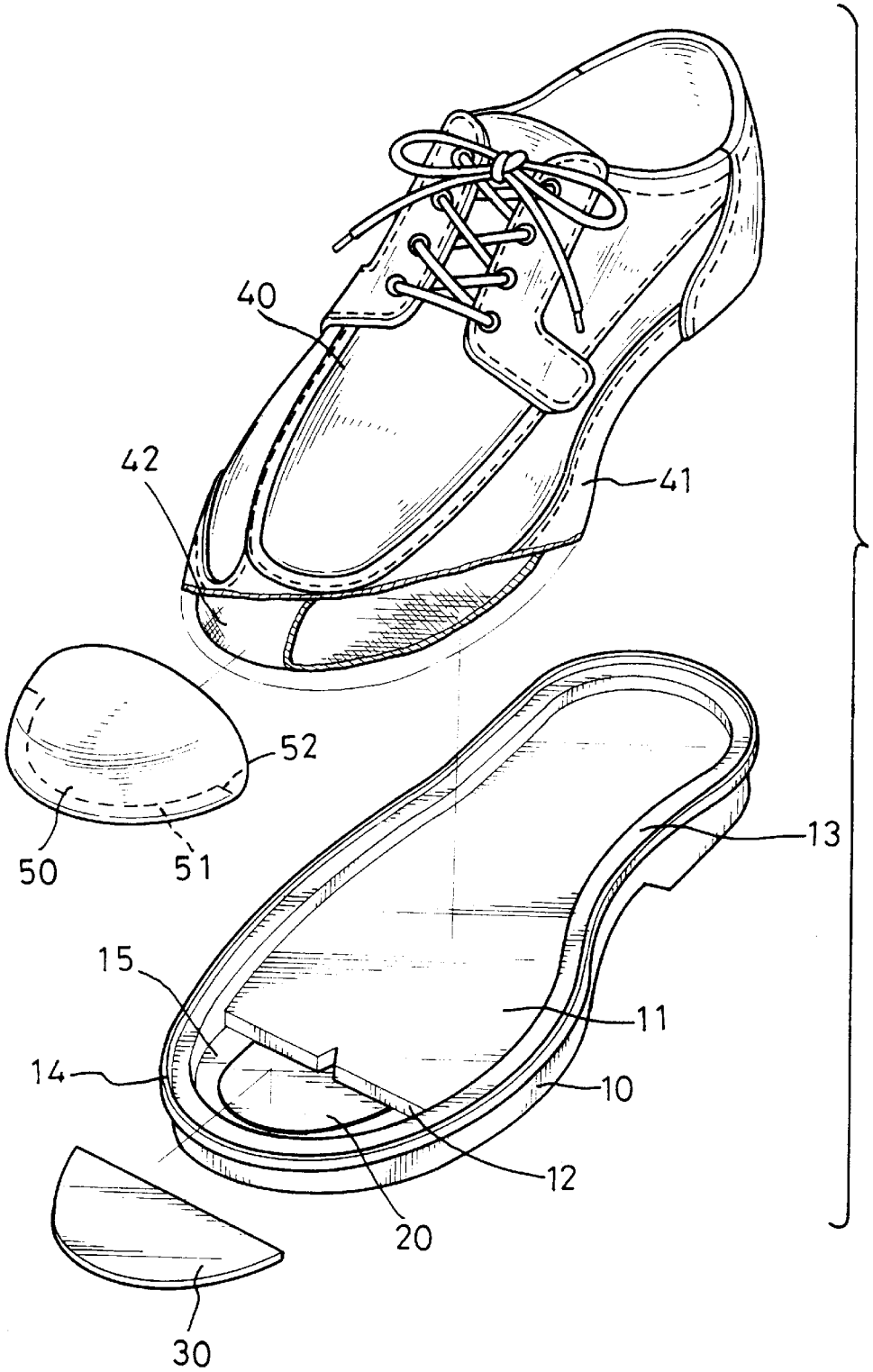
FIG. 2 is an exploded view of the heavy duty shoe shown in FIG. 1.
Figure 3:
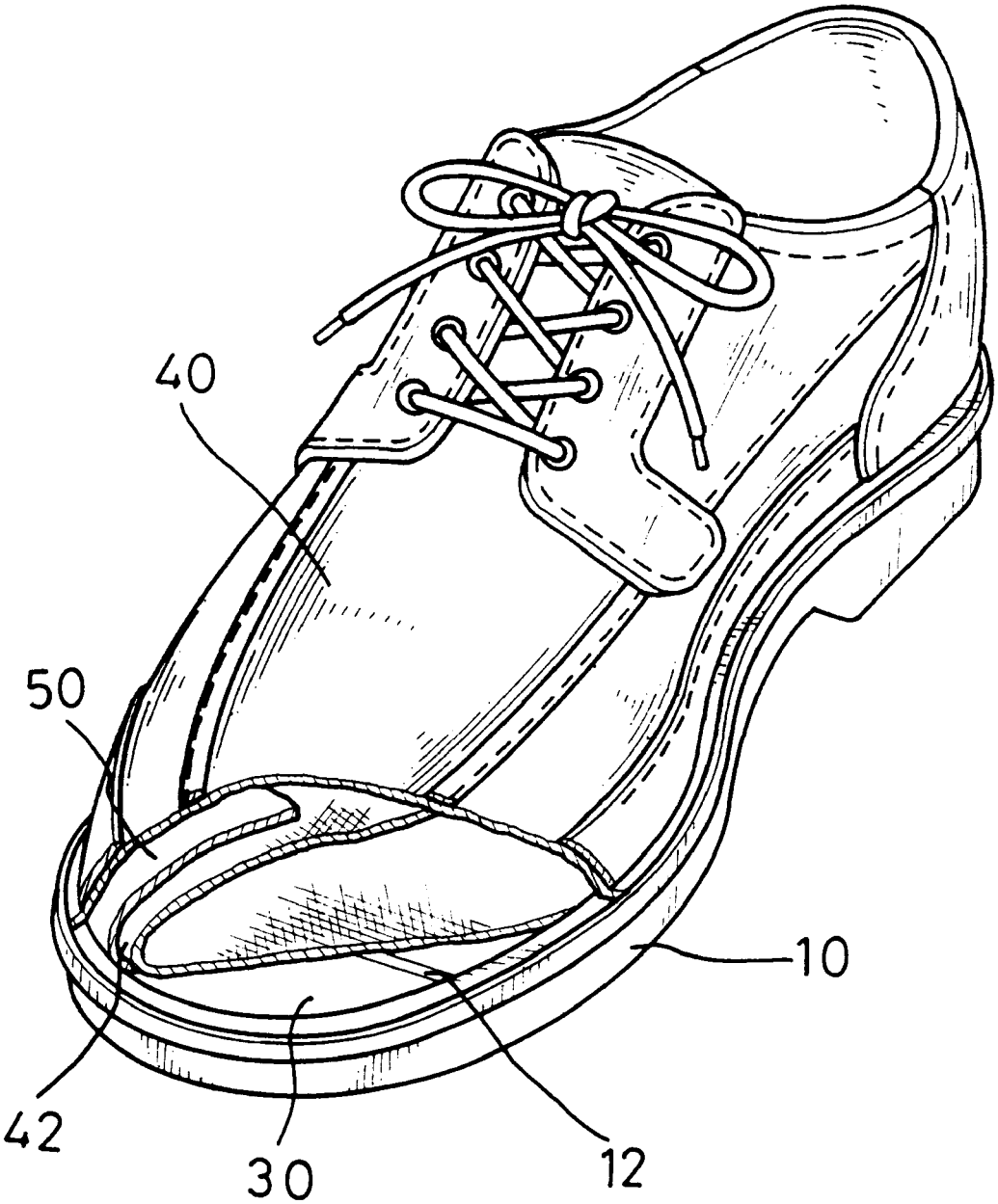
FIG. 3 is a partial cross sectional view of the heavy duty shoe shown in FIG. 1.
Figure 4:
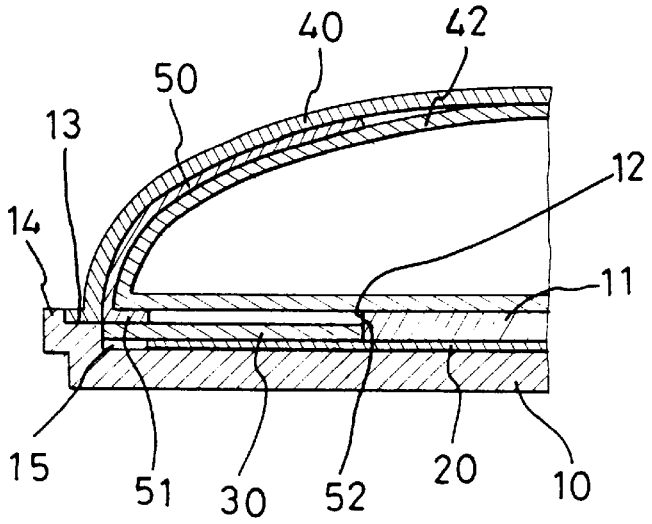
FIG. 4 is a partial cross sectional view taken from line 4—4 of FIG. 1.
Figure 5:
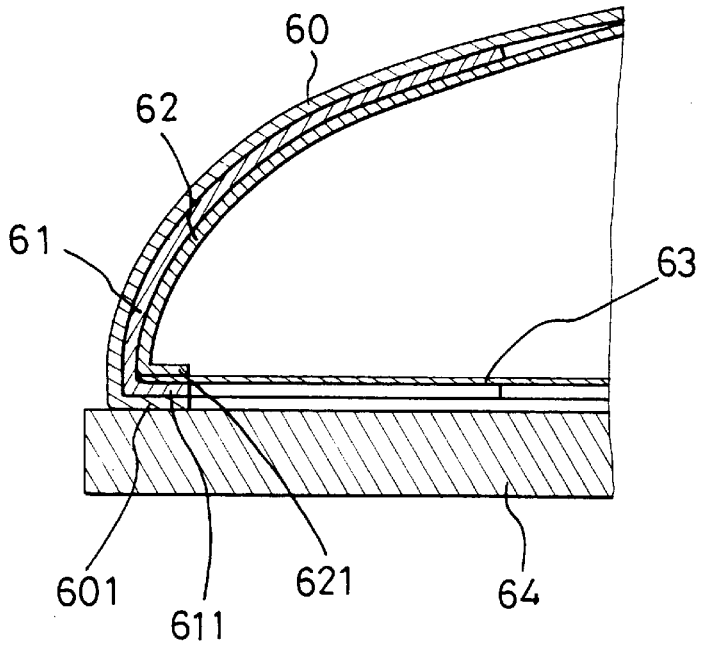
FIG. 5 PRIOR ART
FIG. 5 is a partial cross sectional view showing an internal structure of a conventional heavy duty boot.

Referring to FIGS. 2 and 3 and taking FIG. 4 for reference, an internal structure of the shoe of the invention is shown. Separating the vamp 40 together with the quarter 41 with the sole 10, a securing edge 13 adjacent to the welt 14 is formed on a peripheral side of a shoe pad 11 for securing connecting with the quarter 41. The shoe pad 11 is placed on the sole 10 and has an edge 12 facing a front portion of the shoe. A recess 15 is defined between the edge 12 of the shoe pad 11 and the front portion of the shoe, such that a pad 30 having a thickness thinner than a thickness of the shoe pad 11 and mated with the recess 15 is able to be placed into the recess 15. Furthermore, a steel plate 20 is fixedly placed in the sole 10 for protecting the transverse arch from being hurt by some sharpened object piercing through the sole 10. An arcuate steel cap 50 having a peripherally formed fold 51 is securely disposed in the front portion of the shoe, such that toes of the user will be protected. Due to the thickness difference between the pad 30 and the shoe pad 11, an inclination toward the front portion of the shoe is present. The fold 51 of the steel cap 50 has two ends 52 which will against the edge 12 of the shoe pad 11 when placed in the front portion of the shoe, so that the steel cap 50 will not be moved. After the steel cap 50 is mounted within the front portion of the shoe and the ends 52 securely abut the edge 12 of the shoe pad 11, the fold 51 will flush with the shoe pad 11. Thus, only a partial space of the recess 15 is left inclined.

A lining 42 after being formed by a "STROBEL CONSTRUCTION" is securely attached to an inner face of the vamp 40 and the quarter 41 and also disposed on top of the pad 30 and the shoe pad 11. Therefore, when the user is wearing the heavy duty shoe, the inclination in the front portion of the shoe will provide an ergonomic environment to the user's foot.

It is notable that the heavy duty shoe has the following advantages:

1. light weight;
2. durable;
3. protective and comfortable; and
4. elegant.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heavy duty shoe comprising:

a vamp;

a quarter securely and peripherally attached to the vamp;

a sole having a peripherally formed securing edge for securely attaching to a periphery of the quarter and a steel plate fixedly disposed therein;

a shoe pad disposed on top of the sole and having an edge;

a recess defined in a front portion of the shoe;

a pad disposed in the recess and abutting the edge of the shoe pad;

a lining formed by Strobel construction and disposed within the shoe; and a steel cap securely disposed in a front portion of the shoe and between the vamp and the lining.

2. The shoe as claimed in claim 1, wherein the steel cap has two ends securely against the edge of the shoe pad.

3. The shoe as claimed in claim 1, wherein the pad has a thickness thinner than a thickness of the shoe pad.

4. The shoe as claimed in claim 2, wherein the two ends of the steel cap are flush with the shoe pad.

* * * * *